US006737592B1

(12) United States Patent
Hoang et al.

(10) Patent No.: US 6,737,592 B1
(45) Date of Patent: May 18, 2004

(54) SWITCH ASSEMBLY FOR OPERATING A DEVICE IN DIFFERENT OPERATIONAL MODES

(75) Inventors: Andy Anh Hoang, Lake in the Hills, IL (US); John Mathew, Barrington, IL (US); Jeffrey C. Pflug, Winfield, IL (US); Robert Kosberg, Wildwood, IL (US)

(73) Assignee: Motorola, Inc., Schaumburg, IL (US)

( * ) Notice: Subject to any disclaimer, the term of this patent is extended or adjusted under 35 U.S.C. 154(b) by 44 days.

(21) Appl. No.: 10/389,406

(22) Filed: Mar. 14, 2003

(51) Int. Cl.[7] ..... H01H 3/00
(52) U.S. Cl. ..... 200/1 B; 200/5 R; 200/339
(58) Field of Search ..... 200/1 B, 5 R, 200/6 R, 517, 6 A, 310, 313, 315, 317, 339

(56) References Cited

U.S. PATENT DOCUMENTS 5,403,984 A * 4/1995 Ogawa ..... 200/517
5,430,261 A * 7/1995 Malone ..... 200/1 B
5,669,487 A 9/1997 Sakata ..... 362/255
5,693,920 A * 12/1997 Maeda ..... 200/1 B
5,717,176 A 2/1998 Dahlstrom ..... 200/1 B
5,834,716 A * 11/1998 Lee ..... 200/5 R
5,918,966 A 7/1999 Arnold ..... 200/339
6,054,655 A * 4/2000 Rudolph et al. ..... 200/16 R
6,158,867 A * 12/2000 Parker et al. ..... 362/29
6,274,826 B1 * 8/2001 Serizawa et al. ..... 200/5 R
6,437,259 B1 * 8/2002 Geppert et al. ..... 200/5 R
6,610,945 B2 * 8/2003 Onodera ..... 200/315
2001/0001270 A1 5/2001 Vigliaturo

* cited by examiner

*Primary Examiner*—Michael A. Friedhofer
(74) *Attorney, Agent, or Firm*—Thomas V. Miller; Brian M. Mancini

(57) ABSTRACT

A switch assembly (20) comprising of a base portion (22), a flexible pad (24), a paddle (26), and at least one button (28). The flexible pad (24) has a first dome (44) and a second dome (46). The paddle (26) is slidably attached to the base portion (22) and has a first end portion (64) and a second end portion (66). The first end portion (64) of the paddle (26) is positioned adjacent to the first dome (44) of the flexible pad (24). The second end portion (66) of the paddle (26) is positioned adjacent to the second dome (46) of the flexible pad (24). The button (28) is slidably attached to the base portion (22) and is capable of contacting the paddle (26). The first dome (44) of the flexible pad (24) is capable of collapsing when a user applies a first force ($F_A$) to the button (28). The second dome (46) of the flexible pad (24) is capable of collapsing when the user applies a second force ($F_B$) to the button (28), the second force ($F_B$) being greater in value than the first force ($F_A$). The switch assembly (20) may further include a white light emitting diode (80) for providing a colored light for the switch assembly (20) through the use of the flexible pad (24).

27 Claims, 3 Drawing Sheets

SWITCH ASSEMBLY FOR OPERATING A DEVICE IN DIFFERENT OPERATIONAL MODES

FIELD OF THE INVENTION

This invention in general relates to a switch assembly and, more particularly, to a switch assembly for operating a device (such as a power window in a vehicle) in different operational modes.

BACKGROUND OF THE INVENTION

In electric power window applications for a vehicle, it is desirable to have a switch assembly that can be actuated by a passenger in both push-push and push-lift motions. This type of push-push and push-lift switch assembly is desirable to allow a window to open with a first push of a switch and then automatically open with a second push of a switch. Additionally, it is desirable that the same switch assembly allows the passenger to close the window by applying another force.

Conventional switch assemblies have their drawbacks. For example, U.S. Pat. No. 5,669,487 describes a key top mounting structure for connecting a key top to an operating lever. The key top mounting structure provides a switch operating mechanism that can be used in both a push-push type and a push-pull type switch. However, the switch assembly there requires a complicated mechanical actuating assembly that employs spring contacts. Spring contacts create undesirable noise when actuating. Additionally, the spring contacts are expensive and require excessive parts.

U.S. Pat. No. 5,717,176 describes a switch assembly that includes a membrane having multiple detents. The membrane switch completes a pair of electric circuits to activate two modes. Although this switch assembly overcomes some of the problems of spring contacts, the assembly does not include functionality for a push-push type and a push-pull type switch.

A need exists for improved devices and methods for providing a push-push type and a push-pull type actuation. For instance, a need exists to reduce the noise and the cost in prior switch assemblies. There is also a need to reduce the number of parts needed in a switch assembly. Additionally, there is a need to integrate specific types of color lighting within the switch assembly to provide illumination during night applications. In high volume applications, the integrated color lighting needs to be a low cost design.

It is, therefore, desirable to provide an improved device and method of providing a switch assembly for operating a device in different operational modes to overcome most, if not all, of the preceding problems.

Figure 1:
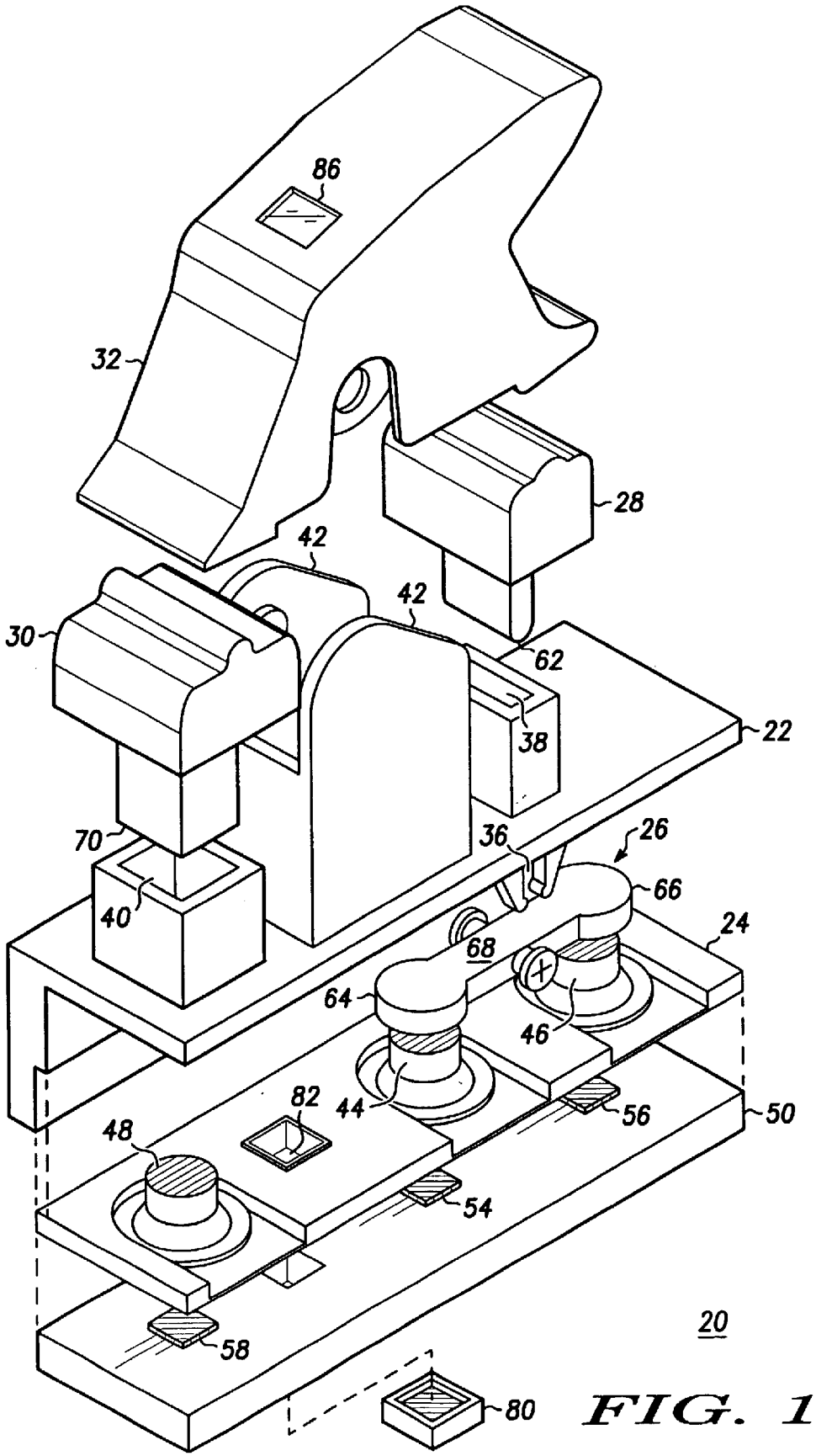
FIG. 1 is an exploded perspective view of one embodiment of a switch assembly according to the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the appended claims.

DETAILED DESCRIPTION

What is described is a device and method of providing a switch assembly for operating a device in different operational modes. For purposes of illustration, an example of the device and method will be described in the context of an electronic switch assembly for a vehicle. However, the present invention is not limited to switch assemblies in vehicles but may also apply to other items where multi-mode actuation is needed.

To this end, in one embodiment there is a switch assembly comprising of a base portion, a flexible pad, a paddle, and at least one button. The flexible pad has a first dome and a second dome. The paddle is slidably attached to the base portion and has a first end portion and a second end portion. The first end portion of the paddle is positioned adjacent to the first dome of the flexible pad. The second end portion of the paddle is positioned adjacent to the second dome of the flexible pad. The button is slidably attached to the base portion and is capable of contacting the paddle. The first dome of the flexible pad is capable of collapsing when a user applies a first force to the button. The second dome of the flexible pad is capable of collapsing when the user applies a second force to the button, the second force being greater in value than the first force.

The switch assembly may further include a lever that is rotatably attached to the base portion and capable of contacting a top portion of the button when the user applies the first force and the second force. The switch assembly may further include a second button that is slidably attached to the base portion. In this case, the lever would then also be capable of contacting a top portion of the second button when the user applies a third force, the third force being in an opposite direction of the first force and the second force. In any event, the switch assembly may be used to operate a device (such as a power window in a vehicle) in different operational modes.

Moreover, in a further embodiment, the switch assembly may include a white light emitting diode. In this case, the base portion of the switch assembly is mounted adjacent to a first side of the flexible pad. The white light emitting diode would be mounted adjacent to a second side of the flexible pad. The white light emitting diode could then be used to provide a colored light for the switch assembly on the first side of (he flexible pad, as will be explained in more detail below.

Another embodiment includes a switch assembly comprising a base portion, a flexible pad, a paddle, a button, and a lever. The flexible pad has a first dome and a second dome. The paddle is slidably attached to the base portion and has a first end portion and a second end portion. The first end portion of the paddle is positioned adjacent to the first dome of the flexible pad. The second end portion of the paddle is positioned adjacent to the second dome of the flexible pad. The button is slidably attached to the base portion and has a bottom portion that is capable of contacting the paddle. The lever is rotatably attached to the base portion and capable of contacting a top portion of the button. The first dome of the flexible pad is capable of collapsing when a user applies a first force to the lever. The second dome of the flexible pad is capable of collapsing when the user applies a second force to the lever, the second force being greater in value than the first force.

In a further embodiment, there is a switch assembly having a flexible pad, a base portion, a lever, and a white light emitting diode. The flexible pad has a first dome, a second dome, and a translucent portion. The base portion is mounted adjacent to a first side of the flexible pad. The lever is rotatably attached to the base portion and has an opening to allow for the transmission of light. The white emitting diode is mounted adjacent to a second side of the flexible pad at the translucent portion and capable of providing a colored light for the switch assembly on the second side of the flexible pad and through the opening of the lever. The first dome of the flexible pad is capable of collapsing when a user applies a first force to the lever. The second dome of the flexible pad is capable of collapsing when the user applies a second force to the lever.

Figure 2:
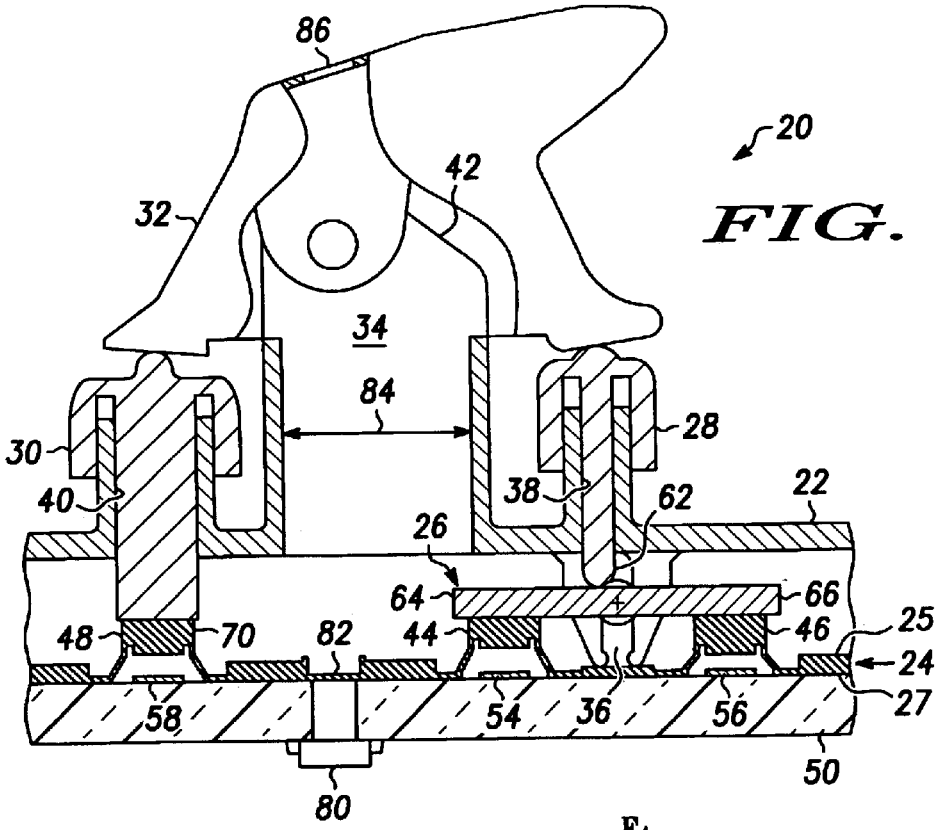
FIG. 2 is a cross-sectional view of a switch assembly according to the present invention.

Now, turning to the drawings, an example use of a device will be explained in the context of an electronic switch assembly for a vehicle. FIGS. 1 and 2 show an example switch assembly 20 that may reside within a vehicle for operating a power window in the vehicle. In one embodiment, generally, the switch assembly 20 may include a base portion 22, a flexible pad 24, a paddle 26, a first button 28, a second button 30, and a lever 32.

The base portion 22 may have various configurations but should be made of a rigid material such as molded plastic, although other types of material may be used. In one embodiment, as shown in FIGS. 1 and 2, the base portion 22 has a main body 34, a slot 36, a first hole 38, a second hole 40, and a pair of holding arms 42. The slot 36 may be used to retain a slidably attached paddle 26. The first hole 38 may be used to retain a slidably attached first button 28. The second hole 40 may be used to retain a slidably attached second button 30. And, the pair of holding arms 42 may be used to retain a rotatably attached lever 32.

The flexible pad 24 is preferably made from an elastromeric material. In one embodiment, the flexible pad 24 may be made of a polycarbonate, acrylic or silicon rubber material. Polycarbonate and acrylic materials exhibit good characteristics in strength, which is necessary for vehicular applications. Polycarbonate and acrylic materials can also be obtained with different transparent and translucent characteristics that can be advantageously used in the present invention as will be explained in more detail below. Examples of suitable polycarbonate materials have been found to include Makrolon® 2405 from Bayer AG and Lexan(® 123 from General Electric. A suitable acrylic material has been found to be Acrylite® S10.

In one embodiment, the flexible pad 24 has a first dome 44, a second dome 46, and a third dome 48. The base portion 22 is mounted adjacent to a first side 25 of the flexible pad 24. A printed circuit board 50 may be mounted adjacent to a second side 27 of the flexible pad 24. The printed circuit board 50 holds electrical circuits and components for operating any devices controlled by the switch assembly 20. The printed circuit board 50 may have electrical switches 54, 56, 58 located adjacent to, and possibly within, each of the first dome 44, the second dome 46, and the third dome 48.

The paddle 26 is slidably attached to the base portion 22 within the slot 36. The paddle 26 has a first end portion 64, a second end portion 66, and a center portion 68. As shown in FIGS. 1 and 2, in one embodiment, the center portion 68 is positioned between the first end portion 64 and the second end portion 66 and may include a circular knob that slides within the slot 36 of the base portion 22. In addition to being slidably attached to the base portion 22, the knob in the center portion 68 allows the paddle 26 to be rotatably attached to the base portion 22 within the slot 36.

The first end portion 64 of the paddle 26 is positioned adjacent to the first dome 44 of the flexible pad 24. The second end portion 66 of the paddle 26 is positioned adjacent to the second dome 46 of the flexible pad 24.

The first button 28 is slidably attached to the base portion 22 within the first hole 38. The first button 28 has a bottom portion 62 that is capable of contacting the paddle 26. In one embodiment, the point where the bottom portion 62 of the first button 28 contacts the paddle 26 should be located off center of the paddle 26. As will be seen below, this assists in allowing the first dome 44 to collapse in response to a first force applied to the first button 28 and the second dome 46 to collapse in response to a second force applied to the first button 28; wherein, the second force is greater in value than the first force. The first button 28 should be made of a rigid material such as molded plastic, although other types of material may be used.

The second button 30 is slidably attached to the base portion 22 within the second hole 40. In one embodiment, the second button 30 has a bottom portion 70 that is capable of contacting the third dome 48 of the flexible pad 24. As will be explained in more detail below, this assists in allowing the third dome 48 to collapse in response to a third force applied to the second button 30. The second button 30 should be made of a rigid material such as molded plastic, although other types of material may be used.

The lever 32 is rotatably attached to the base portion 22 of the switch assembly 20. In particular, the lever 32 may be rotatably attached at the holding arms 42 of the base portion 22 and positioned between the first button 28 and the second button 30. This will assist in allowing the first dome 44 to collapse in response to a first force applied to the lever 32 and the second dome 46 to collapse in response to a second force applied to the lever 32. This will also assist in allowing the third dome 48 to collapse in response to a third force applied to the lever 32; wherein, the third force is in an opposite direction of the first force and the second force. In any event, the lever 32 should be made of a rigid material such as molded plastic, although other types of material may be used.

In applications where the switch assembly 20 is used to operate a window in a vehicle, the first force applied to the lever 32 may be capable of operating the window in a first operational mode. The first operational mode may include allowing the window to open at a reduced speed only when the first force is applied to the lever 32. The second force applied to the lever 32 may be capable of operating the window in a second operational mode. The second operational mode may include allowing the window to open at a higher speed, and automatically, after the second force is applied to the lever 32. The third force applied to the lever 32, and in a direction of the second button 30, may be capable of operating the window in a third operational mode. The third operational mode may include allowing the window to close when the third force is applied to the lever 32.

Figure 3:
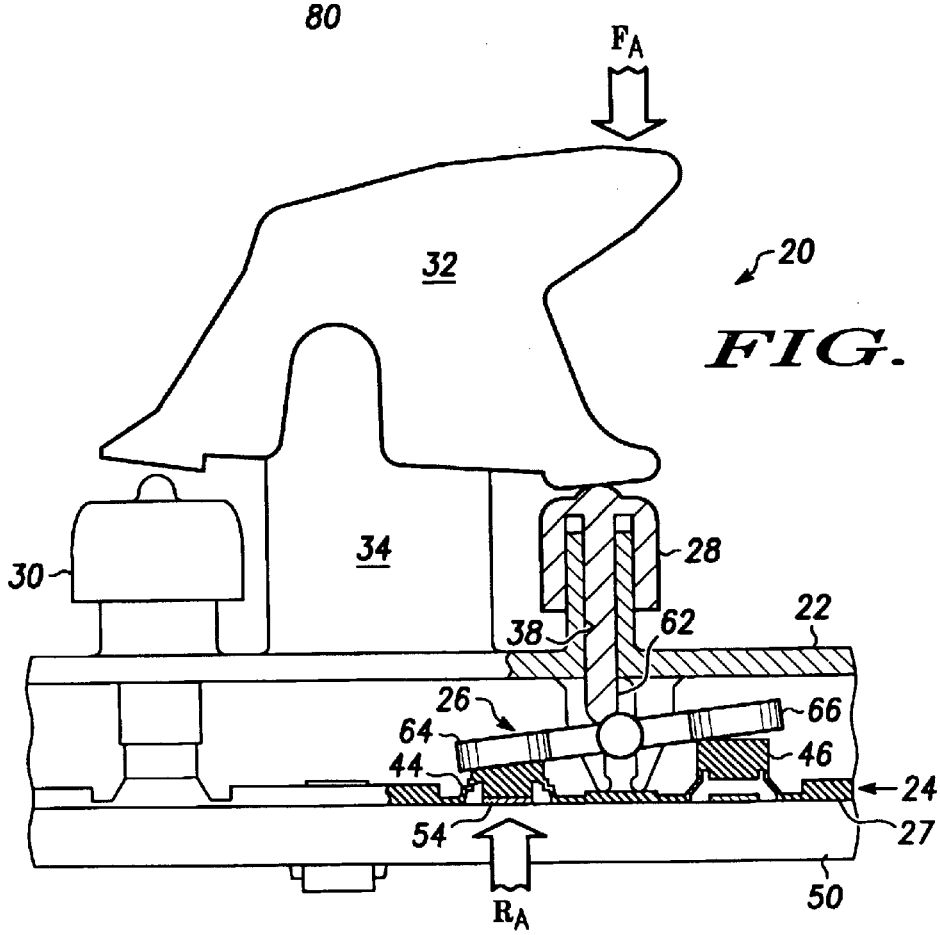
FIG. 3 is a partial cross-sectional view of the switch assembly in FIG. 2 after applying a first force.
Figure 4:
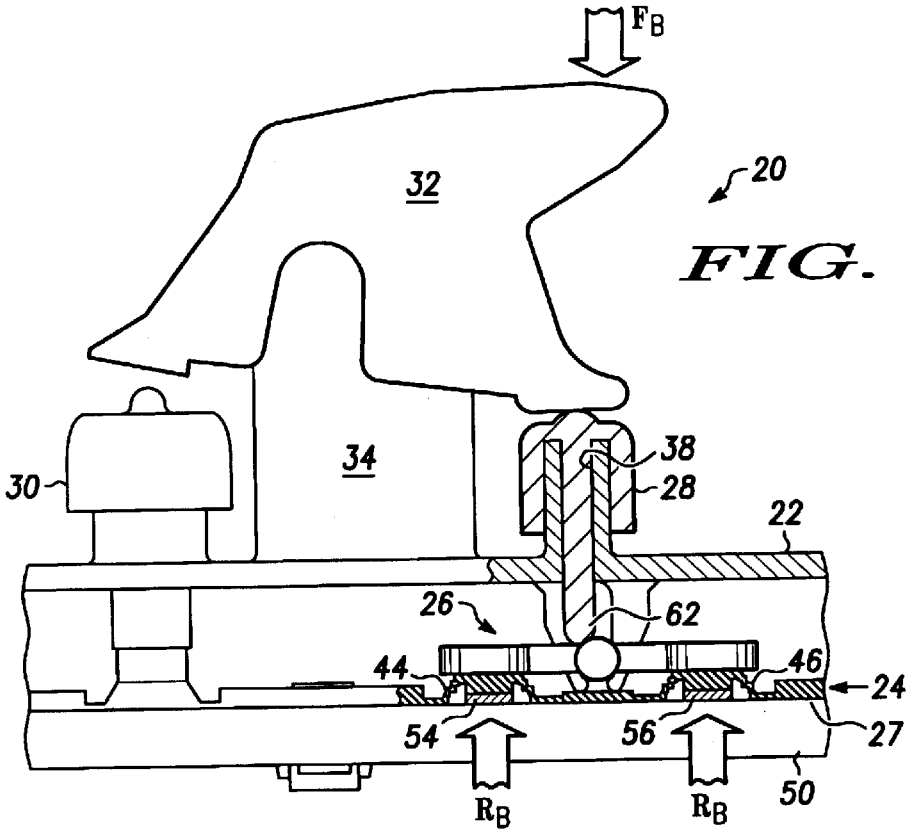
FIG. 4 is a partial cross-sectional view of the switch assembly in FIG. 2 after applying a second force.
Figure 5:
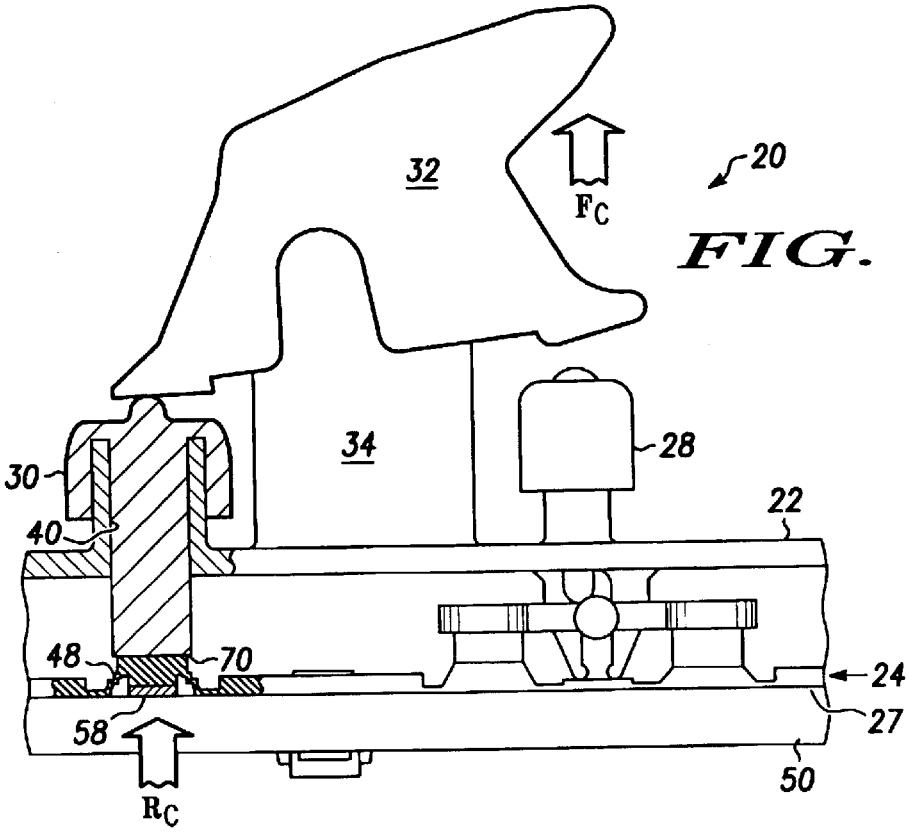
FIG. 5 is a partial cross-sectional view of the switch assembly in FIG. 2 after applying a third force.

FIGS. 3–5 further illustrate the operation of the switch assembly 20. Referring initially to FIG. 3, a partial cross-sectional view of the switch assembly 20 is shown after the application of a first force $F_A$ on the lever 32. A first force $F_A$ applied to the lever 32 will result in the first force $F_A$ being applied on the first button 28. The first button 28 will then slide downward within the first slot 38 of the base portion 22 of the switch assembly 20. The first force $F_A$ will then translate to the paddle 26 through the bottom portion 62 of the first button 28. In this embodiment, the bottom portion 62 of the first button 28 is slightly off center of the paddle 26. This assists in a greater force being applied to the first end portion 64 of the paddle 26 than to the second end portion 66 of the paddle 26. Additionally, the thickness of the walls of the first dome 44 of the flexible pad 24 may be designed to collapse in response to a force that is lighter than a force applied to the second dome 46 of the flexible pad 24.

In any event, at least a portion of the first force $F_A$ will translate to the first dome 44 of the flexible pad 24. A reactionary force $F_A$ will result from the bottom or second side 27 of the flexible pad 24 due to the printed circuit board 50. The presence of the first force $F_A$ and the reactionary force $R_A$ will cause the first dome 44 to collapse. When the first dome 44 collapses, an interior portion of the first dome 44 will contact a switch 54 on the printed circuit board 50. The printed circuit board 50 may be designed such that, upon activation of the switch 54, a device such as a power window will operate in a first operational mode.

Referring to FIG. 4, a partial cross-sectional view of the switch assembly 20 is shown after the application of a second force $F_B$ on the lever 32. In this case, the second force $F_B$ is designed to be greater in value than the first force $F_A$. The second force $F_B$ applied to the lever 32 will result in the second force $F_B$ being also applied on the first button 28. The first button 28 will then slide further downward within the first slot 38 of the base portion 22 of the switch assembly 20. The second force $F_B$ will then translate to the paddle 26 through the bottom portion 62 of the first button 28. At least a portion of the second force $F_B$ will translate to the second dome 46 of the flexible pad 24. Again, a reactionary force $R_B$ will result from the bottom or second side 27 of the flexible pad 24 due to the printed circuit board 50. The presence of the second force $F_B$ and the reactionary force $R_B$ will cause the second dome 46 to collapse (in addition to the already collapsed first dome 44). When the second dome 46 collapses, an interior portion of the second dome 46 will contact a switch 56 on the printed circuit board 50. The printed circuit board 50 may be designed such that, upon activation of the switch 56, a device such as a power window will operate in a second operational mode.

Referring to FIG. 5, a partial cross-sectional view of the switch assembly 20 is shown after the application of a third force $F_C$ on the lever 32. In this case, the third force $F_C$ is designed to be in a direction opposite of the first force $F_A$ and the second force $F_B$. The third force $F_C$ applied to the lever 32 will result in the third force $F_C$ being applied on the second button 30. The second button 30 will then slide downward within the second slot 40 of the base portion 22 of the switch assembly 20. The third force $F_C$ will then translate to the third dome 48 of the flexible pad 24. A reactionary force $R_C$ will result from the bottom or second side 27 of the flexible pad 24 due to the printed circuit board 50. The presence of the third force $F_C$ and the reactionary force $R_C$ will cause the third dome 48 to collapse. When the third dome 48 collapses, an interior portion of the third dome 48 will contact a switch 58 on the printed circuit board 50. The printed circuit board 50 may be designed such that, upon activation of the switch 58, a device such as a power window will operate in a third operational mode.

The flexible pad 24 should be designed such that the first dome 44, the second dome 46, and the third dome 48 return to a non-collapsed position if no force is being applied to the lever 32. For example, when the first force $F_A$ (shown in FIG. 3) or the second force $F_B$ (shown in FIG. 4) is released, the switch assembly 20 should be designed to return to the configuration shown in FIG. 2. Additionally, when the third force $F_C$ (shown in FIG. 5) is released, the switch assembly 20 should also be designed to return to the configuration shown in FIG. 2.

In a further embodiment of the invention, referring back to FIGS. 1 and 2, the switch assembly 20 includes a white light emitting diode (LED) 80. The LED 80 may be attached to the printed circuit board 50. This may allow the LED 80 to be mounted adjacent to the second side 27 of the flexible pad 24. As explained in more detail below, the LED 80 is capable of providing a colored light for the switch assembly 32 on the first side 25 of the flexible pad 24.

In one embodiment, the flexible pad 24 has a translucent portion 82 having a predetermined thickness. As mentioned above, a suitable material for the flexible pad 24 (and translucent portion 82) has been found to be a polycarbonate or acrylic material. The base portion 22 has a hollow center portion 84. And, the lever 32 has an opening 86 to allow for the transmission of light. The white LED 80 provides the colored light for the switch assembly 20 on the second side 25 of the flexible pad 24, through the hollow center portion 84 of the base portion 22, and through the opening 86 in the lever 32.

In this embodiment, the flexible pad 24 serves a dual purpose. A first purpose is to act as part of the actuation mechanism through the use of the first dome 44, the second dome 46, and the third dome 48. A second purpose is to act as a color filter for the white LED 80. Positioning the white. LED 80 adjacent to the translucent portion 82 of the flexible pad 24 does this. The exact color that results on the first side 25 of the flexible pad 24 will be a function of the material type and the thickness of the translucent portion 82 of the flexible pad 24. The transmission of the white light through the translucent portion 82 of the flexible pad 24 shifts the white color into a specific color spectrum. Varying the material type and the thickness of the translucent portion 82 of the flexible pad 24 allows a manufacturer of the switch assembly 20 the flexibility to shift the white light to any desirable color listed in the industry known 1931 C.I.E. color chart. This color chart was developed in 1931 by the Commission Internationale de l'Eclairage (International Commission on Illumination) and was based on the concept that colors can be matched by adding one or more of three primary colors (red, green, blue).

The advantage to using this type of color filtering is that it reduces cost, which is particularly important in high volume applications. In particular, conventional methods use active filtering methods to achieve a desirable color such as a self colored diode using additional phosphor. A self colored light emitting diode using additional phosphor costs more than a standard white light emitting diode. The present invention advantageously makes use of the flexible pad 24 for multiple purposes. In addition to assisting in the actuation mechanism, the flexible pad 24 acts to serve as a filter for the lower cost white LED to produce a desired colored light. In particular, the present invention uses a passive filtering technique, which is considerably less expensive than the active filtering method. This is accomplished by varying the thickness of the translucent portion 82 of the flexible pad 24. This method of passive filtering includes the blocking of a percentage of certain wavelength by increasing or decreasing the translucent portion 82 to achieve a desired color in the 1931 C.I.E. color chart, as seen by the user at the opening 86 in the lever 32 of the switch assembly 20.

What has been described is a device and method for providing a push-push type and a push-pull type actuation in a switch assembly. The device and method permits a switching assembly to operate in multiple operational modes while reducing noise and cost. The device and method also reduces the number of parts needed in prior switch assemblies. The present invention further permits the inclusion of a background color lighting scheme that advantageously uses existing pants of the switch assembly.

The above description of the present invention is intended to be exemplary only and is not intended to limit the scope of any patent issuing from this application. For example, the present discussion used a switch assembly in a vehicle to illustrate the device of the present invention. The present invention is also applicable to other applications that require a switch assembly that supports multiple operational modes. The present invention is intended to be limited only by the scope and spirit of the following claims.

What is claimed is:

1. A switch assembly comprising:

a base portion;

a flexible pad having a first dome and a second dome;

a paddle that is slidably attached to the base portion, the paddle having a first end portion and a second end potion, the first end portion of the paddle adjacent to the first dome of the flexible pad, the second end portion of the paddle adjacent to the second dome of the flexible pad; and a button that is slidably attached to the base portion and capable of contacting the paddle;

wherein the first dome of the flexible pad is capable of collapsing when a user applies a first force to the button, the second dome of the flexible pad is capable of collapsing when the user applies a second force to the button, the second force being greater in value than the first force.

2. The switch assembly of claim 1 further comprising a lever, the lever being rotatably attached to the base portion and capable of contacting a top portion of the button when the user applies the first force and the second force.

3. The switch assembly of claim 1 wherein the switch assembly is used to operate a window in a vehicle, the first force applied to the button capable of operating the window in a first operational mode, the second force applied to the button capable of operating the window in a second operational mode.

4. The switch assembly of claim 3 wherein the first operational mode allows the window to open only when the first force is applied to the button, the second operational mode allows the window to open automatically after the second force is applied to the button.

5. The switch assembly of claim 2 further comprising a second button that is slidably attached to the base portion, the lever further capable of contacting a top portion of the second button when the user applies a third force, the third force being in an opposite direction of the first force and the second force.

6. The switch assembly of claim 5 wherein the switch assembly is used to operate a window in a vehicle, the first force applied to the button capable of operating the window in a first operational mode, the second force applied to the button capable of operating the window in a second operational mode, the third force applied to the button capable of operating the window in a third operational mode.

7. The switch assembly of claim 6 wherein the first operational mode allows the window to open only when the first force is applied to the button, the second operational mode allows the window to open automatically after the second force is applied to the button, and the third operational mode allows the window to close only when the third force is applied to the button.

8. The switch assembly of claim 1 wherein the flexible pad is made of a polycarbonate material.

9. The switch assembly of claim 8 further comprising a white light emitting diode, the base portion mounted adjacent to a first side of the flexible pad, the white light emitting diode mounted adjacent to a second side of the flexible pad, the white light emitting diode capable of providing a colored light for the switch assembly on the first side of the flexible pad.

10. The switch assembly of claim 1 wherein the flexible pad includes a translucent portion for passively filtering light from a white light emitting diode.

11. A switch assembly comprising:

a base portion;

a flexible pad having a first dome and a second dome;

a paddle that is slidably attached to the base portion, the paddle having a first end portion and a second end portion, the first end portion of the paddle adjacent to the first dome of the flexible pad, the second end portion of the paddle adjacent to the second dome of the flexible pad;

a button that is slidably attached to the base portion, the button having a bottom portion that is capable of contacting the paddle;

a lever that is rotatably attached to the base portion, the lever capable of contacting a top portion of the button;

wherein the first dome of the flexible pad is capable of collapsing when a user applies a first force to the lever, the second dome of the flexible pad is capable of collapsing when the user applies a second force to the lever, the second force being greater in value than the first force.

12. The switch assembly of claim 11 wherein the switch assembly is used to operate a window in a vehicle the first force applied to the lever capable of operating the window in a first operational mode, the second force applied to the lever capable of operating the window in a second operational mode.

13. The switch assembly of claim 12 wherein the first operational mode allows the window to open only when the first force is applied to the lever, the second operational mode allows the window to open automatically after the second force is applied to the lever.

14. The switch assembly of claim 11 further comprising a second button that is slidably attached to the base portion, the lever further capable of contacting a top portion of the second button when the user applies a third force to the lever, the third force being in an opposite direction of the first force and the second force.

15. The switch assembly of claim 14 wherein the switch assembly is used to operate a window in a vehicle, the first force applied to the lever capable of operating the window in a first operational mode, the second force applied to the lever capable of operating the window in a second operational mode, the third force applied to the lever capable of operating the window in a third operational mode.

16. The switch assembly of claim 15 wherein the first operational mode allows the window to open only when the first force is applied to the lever, the second operational mode allows the window to open automatically after the second force is applied to the lever, and the third operational mode allows the window to close only when the third force is applied to the lever.

17. The switch assembly of claim 11 wherein the flexible pad is made of a polycarbonate material.

18. The switch assembly of claim 17 further comprising a white light emitting diode, the base portion mounted adjacent to a first side of the flexible pad, the white light emitting diode mounted adjacent to a second side of the flexible pad, the white light emitting diode capable of providing a colored light for the switch assembly on the first side of the flexible pad.

19. The switch assembly of claim 11 wherein the flexible pad includes a translucent portion for passively filtering light from a white light emitting diode.

20. A switch assembly comprising:

a flexible pad having at least a first dome, a second dome, and a translucent portion;

a base portion mounted adjacent a first side of the flexible pad;

a paddle that is slidably attached to the base portion, the paddle having a first end portion and a second end portion, the first end portion of the paddle adjacent to the first dome of the flexible pad, the second end portion of the paddle adjacent to the second dome of the flexible pad;

a lever that is rotatably attached to the base portion, the lever having an opening to allow for the transmission of light; and a white light emitting diode mounted adjacent a second side of the flexible pad at the translucent portion, the white light emitting diode capable of providing a colored light for the switch assembly on the second side of the flexible pad and through the opening in the lever;

wherein the first dome of the flexible pad is capable of collapsing when a user applies a first force to the lever, the second dome of the flexible pad is capable of collapsing when the user applies a second force to the lever.

21. The switch assembly of claim 20 wherein the switch assembly is used to operate a window in a vehicle, the first force applied to the lever capable of operating the window in a first operational mode, the second force applied to the lever capable of operating the window in a second operational mode.

22. The switch assembly of claim 21 wherein the first operational mode allows the window to open only when the first force is applied to the lever, the second operational mode allows the window to open automatically after the second force is applied to the lever.

23. The switch assembly of claim 20 further comprising a button that is slidably attached to the base portion, the button having a bottom portion that is capable of contacting the paddle and a top portion on that is capable being contacted by the lever.

24. The switch assembly of claim 23 further comprising a second button that is slidably attached to the base portion, the lever further capable of contacting a top portion of the second button when the user applies a third force to the lever, the third force being in an opposite direction of the first force and the second force.

25. The switch assembly of claim 24 wherein the switch assembly is used to operate a window in a vehicle, the first force applied to the lever capable of operating the window in a first operational mode, the second force applied to the lever capable of operating the window in a second operational mode, the third force applied to the lever capable of operating the window in a third operational mode.

26. The switch assembly of claim 25 wherein the first operational mode allows the window to open only when the first force is applied to the lever, the second operational mode allows the window to open automatically after the second force is applied to the lever, and the third operational mode allows the window to close only when the third force is applied to the lever.

27. The switch assembly of claim 20 wherein the flexible pad is made of a polycarbonate material.

* * * * *